US011034548B2

(12) United States Patent
Tracey et al.

(10) Patent No.: US 11,034,548 B2
(45) Date of Patent: Jun. 15, 2021

(54) ELEVATOR DOOR INTERLOCK ASSEMBLY

(71) Applicant: OTIS ELEVATOR COMPANY, Farmington, CT (US)

(72) Inventors: Michael J. Tracey, Cromwell, CT (US); Richard E. Kulak, Niantic, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 409 days.

(21) Appl. No.: 15/967,797

(22) Filed: May 1, 2018

(65) Prior Publication Data

US 2019/0337766 A1 Nov. 7, 2019

(51) Int. Cl.

| | |
|---|---|
| ***B66B 13/20*** | (2006.01) |
| ***B66B 13/12*** | (2006.01) |
| ***B66B 13/22*** | (2006.01) |

(52) U.S. Cl.

CPC ..... *B66B 13/20* (2013.01); *B66B 13/12* (2013.01); *B66B 13/22* (2013.01)

(58) Field of Classification Search

CPC ..... B66B 13/20; B66B 13/12

See application file for complete search history.

(56) References Cited

U.S. PATENT DOCUMENTS

| | | | | |
|---|---|---|---|---|
| 1,950,150 | A * | 3/1934 | Norton | B66B 13/20 187/319 |
| 3,315,767 | A | 4/1967 | Walter | |
| 3,638,762 | A | 2/1972 | Johns | |
| 4,094,385 | A | 6/1978 | Maeda et al. | |
| 4,457,405 | A * | 7/1984 | Johns | B66B 13/12 187/319 |
| 4,923,055 | A | 5/1990 | Holland | |
| 5,446,759 | A | 8/1995 | Campana, Jr. | |

(Continued)

FOREIGN PATENT DOCUMENTS

| | | |
|---|---|---|
| CN | 201610675 U | 10/2010 |
| CN | 204057608 U | 12/2014 |

(Continued)

OTHER PUBLICATIONS

Extended European Search Report for Application No. EP 19 17 2026 dated Sep. 5, 2019.

(Continued)

*Primary Examiner* — Minh Truong

(74) *Attorney, Agent, or Firm* — Carlson, Gaskey & Olds

(57) ABSTRACT

An illustrative example elevator door interlock includes a first base configured to be supported on a hoistway door component, The first base is situated to be selectively pivoted relative to the hoistway door component. A first bumper is supported on the first base such that pivotal movement of the first base changes a position of the first bumper relative to the hoistway door component. A second base is situated to be selectively moved relative to the hoistway door component. A second bumper is supported on the second base such that selective movement of the second base changes a position of the second bumper relative to the hoistway door component. A latch is situated for pivotal movement about a pivot axis relative to the first base between a door locking position and a released position.

16 Claims, 3 Drawing Sheets

(56) References Cited

U.S. PATENT DOCUMENTS

| | | | | |
|---|---|---|---|---|
| 5,538,106 | A | 7/1996 | McHugh et al. | |
| 5,651,427 | A | 7/1997 | Kulak et al. | |
| 5,651,428 | A | 7/1997 | Ahigian et al. | |
| 5,718,055 | A | 2/1998 | Pierce et al. | |
| 5,732,796 | A | 3/1998 | Ahigian et al. | |
| 5,959,266 | A | 9/1999 | Uchiumi | |
| 6,089,355 | A | 7/2000 | Seki et al. | |
| 6,173,813 | B1 | 1/2001 | Rebillard et al. | |
| 6,474,448 | B1 * | 11/2002 | Zappa | B66B 13/20 187/308 |
| 7,147,084 | B2 | 12/2006 | Jahkonen | |
| 7,252,179 | B2 * | 8/2007 | Oberleitner | B66B 13/12 187/315 |
| 7,350,623 | B2 | 4/2008 | Kinoshita et al. | |
| 7,398,862 | B2 | 7/2008 | Dziwak | |
| 7,650,971 | B2 * | 1/2010 | Pillin | B66B 13/245 187/331 |
| 8,939,262 | B2 | 1/2015 | Schienda et al. | |
| 9,260,275 | B2 | 2/2016 | Reuter et al. | |
| 9,302,886 | B2 | 4/2016 | Tantis et al. | |
| 9,637,350 | B2 | 5/2017 | Mittermayr | |
| 9,656,835 | B2 | 5/2017 | Kitazawa | |
| 9,663,329 | B2 | 5/2017 | Zappa | |
| 9,834,413 | B2 | 12/2017 | Mittermayr | |
| 9,845,224 | B2 | 12/2017 | Rasanen et al. | |
| 10,196,237 | B2 | 2/2019 | Kattainen et al. | |
| 2001/0003319 | A1 * | 6/2001 | Itoh | B66B 13/12 187/333 |
| 2012/0000729 | A1 | 1/2012 | Marvin et al. | |
| 2012/0000732 | A1 | 1/2012 | Draper et al. | |
| 2016/0145074 | A1 | 5/2016 | Kattainen et al. | |
| 2017/0190547 | A1 | 7/2017 | Dharmaraj | |
| 2018/0079621 | A1 | 3/2018 | Fauconnet et al. | |
| 2018/0118514 | A1 | 5/2018 | Bruno | |
| 2018/0229972 | A1 | 8/2018 | Kulak et al. | |
| 2018/0265334 | A1 | 9/2018 | Kulak et al. | |
| 2019/0337765 | A1 | 11/2019 | Wang et al. | |
| 2019/0337767 | A1 * | 11/2019 | Tracey | B66B 13/12 |
| 2019/0337768 | A1 * | 11/2019 | Kulak | B66B 19/00 |
| 2019/0337769 | A1 | 11/2019 | Khzouz et al. | |
| 2020/0115192 | A1 | 4/2020 | Montigny et al. | |

FOREIGN PATENT DOCUMENTS

| | | | |
|---|---|---|---|
| CN | 204369335 | U | 6/2015 |
| CN | 103693538 | B | 7/2015 |
| CN | 104773637 | A | 7/2015 |
| CN | 103693539 | B | 11/2015 |
| CN | 103803389 | B | 11/2015 |
| CN | 104176604 | B | 3/2016 |
| CN | 104444734 | B | 3/2016 |
| CN | 105645239 | A | 6/2016 |
| CN | 105936467 | A | 9/2016 |
| CN | 106006324 | A | 10/2016 |
| CN | 106044504 | A | 10/2016 |
| CN | 106081819 | A | 11/2016 |
| CN | 106081820 | A | 11/2016 |
| CN | 106395582 | A | 2/2017 |
| CN | 107176530 | A | 9/2017 |
| CN | 107614412 | A | 1/2018 |
| EP | 2426076 | A1 | 3/2012 |
| EP | 3048075 | B1 | 3/2018 |
| GB | 415931 | | 9/1934 |
| GB | 2358623 | A | 8/2001 |
| JP | H0812228 | | 1/1996 |
| JP | H10203742 | A | 8/1998 |
| JP | 2005008371 | | 1/2013 |
| WO | 2005/077808 | A2 | 8/2005 |
| WO | 2006/080094 | A1 | 8/2006 |
| WO | 2011/104818 | A1 | 9/2011 |
| WO | 2011/137545 | A1 | 11/2011 |
| WO | 2014/122358 | A1 | 8/2014 |
| WO | 2016/085678 | A1 | 6/2016 |
| WO | 2016/176033 | A1 | 11/2016 |
| WO | 2017/023927 | A1 | 2/2017 |
| WO | 2017/187560 | A1 | 11/2017 |

OTHER PUBLICATIONS

Extended European Search Report for Application No. EP 19 17 2040 dated Sep. 23, 2019.

Extended European Search Report for Application No. EP 19 17 2084 dated Mar. 18, 2020.

Extended European Search Report for Application No. EP 19 17 2105 dated Sep. 27, 2019.

The Extended European Search Report for EP Application No. 19172106.7, dated Jan. 31, 2020.

* cited by examiner

ELEVATOR DOOR INTERLOCK ASSEMBLY

BACKGROUND

Elevator systems are in widespread use for carrying passengers between various levels in buildings, for example. Access to an elevator car requires that elevator car doors open when the car is at a landing at which a passenger desires to board the elevator car, for example. Each landing includes hoistway doors that move with the elevator car doors between open and closed positions.

There are various known coupler and interlock arrangements for coupling the elevator car doors to the hoistway doors so that the door mover that causes movement of the car doors also causes desired movement of the hoistway doors. Most door couplers include a set of vanes supported on the elevator car door structure. Most interlocks include a set of rollers supported on the hoistway door structure. When the rollers are received adjacent the vanes, it is possible to move both doors together. The movement of the car doors includes one of the vanes pushing on one of the rollers to move the hoistway door in one direction and the other vane pushing on the other roller to move the hoistway door in the other direction.

It is believed that elevator door system components account for approximately 50% of elevator maintenance requests and 30% of callbacks. Almost half of the callbacks due to a door system malfunction are related to one of the interlock functions.

Another drawback associated with known interlock arrangements is that the process of installing the interlocks along the hoistway is time-consuming and undesirably complicated. Each interlock has to be positioned to receive the coupler vanes as the elevator car approaches the corresponding landing. Inaccurate interlock placement may result in undesired contact between the coupler vanes and the interlock as the elevator car passes the landing, for example. Additionally, adjusting the rollers to achieve the necessary alignment with the coupler requires adjusting the position of the corresponding hoistway door lock and switch to ensure that the interlock properly cooperates with the lock. If the lock and switch components are not accurately positioned, the elevator may not perform reliably as indications from the switches along the hoistway are needed to ensure that all hoistway doors are closed before the elevator car moves along the hoistway.

SUMMARY

An illustrative example elevator door interlock includes a first base configured to be supported on a hoistway door component, The first base is situated to be selectively pivoted relative to the hoistway door component. A first bumper is supported on the first base such that pivotal movement of the first base changes a position of the first bumper relative to the hoistway door component. A second base is situated to be selectively moved relative to the hoistway door component. A second bumper is supported on the second base such that selective movement of the second base changes a position of the second bumper relative to the hoistway door component. A latch is situated for pivotal movement about a pivot axis relative to the first base between a door locking position and a released position.

In an example embodiment having one or more features of the elevator door interlock of the previous paragraph, the first base is selectively pivoted about the pivot axis.

In an example embodiment having one or more features of the elevator door interlock of any of the previous paragraphs, the second base is situated to be selectively pivoted relative to the hoistway door component and the second base is selectively pivoted about the pivot axis.

In an example embodiment having one or more features of the elevator door interlock of any of the previous paragraphs, the second base is situated to be selectively pivoted relative to the first base, the second base is situated to be selectively pivoted relative to the latch, the second base is selectively set in a fixed position relative to the latch, and the second base and the second bumper pivot about the pivot axis with pivotal movement of the latch about the pivot axis when the second base is in the fixed position.

An example embodiment having one or more features of the elevator door interlock of any of the previous paragraphs includes at least one fastener that selectively secures the second base in the fixed position relative to the latch.

In an example embodiment having one or more features of the elevator door interlock of any of the previous paragraphs, when the second base is in the fixed position relative to the latch a mass of the second base urges the latch into the locking position.

In an example embodiment having one or more features of the elevator door interlock of any of the previous paragraphs, the second base is situated to be selected pivoted relative to the latch, at least one of the second base and the latch includes a boss, at least one of the other of the latch and the second base includes an arcuate slot, the boss is at least partially received in the slot, and relative movement between boss and the slot adjusts a relative position between the latch and the second base.

In an example embodiment having one or more features of the elevator door interlock of any of the previous paragraphs, the boss comprises a threaded rod and the elevator door interlock includes a threaded fastener that is received on the threaded rod to selectively secure the second base in a fixed position relative to the latch.

An example embodiment having one or more features of the elevator door interlock of any of the previous paragraphs includes a switch that provides an indication whether the latch is in the locking position, the latch comprises a switch contact that cooperates with the switch when the latch is in the locking position, the switch contact is separated from the switch when the latch is in the released position, and the switch remains in a fixed position relative to the pivot axis.

An example embodiment having one or more features of the elevator door interlock of any of the previous paragraphs includes at least one fastener that selectively holds the first base in a fixed position relative to the hoistway door component.

In an example embodiment having one or more features of the elevator door interlock of any of the previous paragraphs, at least one of pivotal movement of the first base and movement of the second base adjusts a lateral spacing between the first bumper and the second bumper.

In an example embodiment having one or more features of the elevator door interlock of any of the previous paragraphs, there is a first lateral spacing between the first and second bumpers when the latch is in the locking position and there is a second, larger lateral spacing between the first and second bumpers when the latch is in the released position.

In an example embodiment having one or more features of the elevator door interlock of any of the previous paragraphs, the first bumper comprises a roller that is rotatable relative to the first base about a first roller axis that remains fixed relative to the first base and the second bumper comprises a roller that is rotatable relative to the second base about a second roller axis that remains fixed relative to the second base.

In an example embodiment having one or more features of the elevator door interlock of any of the previous paragraphs, the first base includes at least one boss, the latch includes at least one arcuate slot, the boss is at least partially received in the slot, and at least one end of the slot limits pivotal movement of the latch into the released position.

In an example embodiment having one or more features of the elevator door interlock of any of the previous paragraphs, the second base is laterally moveable relative to the pivot axis.

An illustrative example method of installing an elevator door interlock, which has a latch that is configured to pivot about a pivot axis and two bumpers, includes positioning the latch in a selected position relative to a hoistway door, adjusting a position of at least a first one of the bumpers relative to the latch by rotating a first base supporting the first one of the bumpers relative to the hoistway door without moving the pivot axis of the latch, and securing the first base in a selected position that secures the first one of the bumpers in a desired position relative to the hoistway door.

An example embodiment having one or more features of the method of any of the previous paragraphs includes adjusting a position of a second one of the bumpers relative to the latch by moving a second base supporting the second one of the bumpers relative to the hoistway door without moving the pivot axis of the latch and securing the second base in a selected position that secures the second one of the bumpers in a desired position relative to the first one of the bumpers.

In an example embodiment having one or more features of the method of any of the previous paragraphs, moving the second base comprises rotating the second base relative to the first base.

In an example embodiment having one or more features of the method of any of the previous paragraphs, rotating the first base comprises rotating the first base about the pivot axis of the latch and rotating the second base comprises rotating the second base about the pivot axis of the latch.

In an example embodiment having one or more features of the method of any of the previous paragraphs, securing the second base in the selected position comprises securing the second base to the latch such that the second base remains fixed relative to the latch.

In an example embodiment having one or more features of the method of any of the previous paragraphs, the elevator door interlock includes a switch that indicates when the latch is in a locked position and the method comprises establishing a position of the switch relative to the pivot axis of the latch before adjusting the position of the first one of the bumpers.

The various features and advantages of an example embodiment will become apparent to those skilled in the art from the following detailed description. The drawings that accompany the detailed description can be briefly described as follows.

DETAILED DESCRIPTION

Embodiments of this invention provide an elevator door interlock that is easily adjustable for properly aligning the interlock with an elevator door coupler. The alignment can be achieved without requiring any adjustment of relative positions of the latch and lock switch components.

Figure 1:
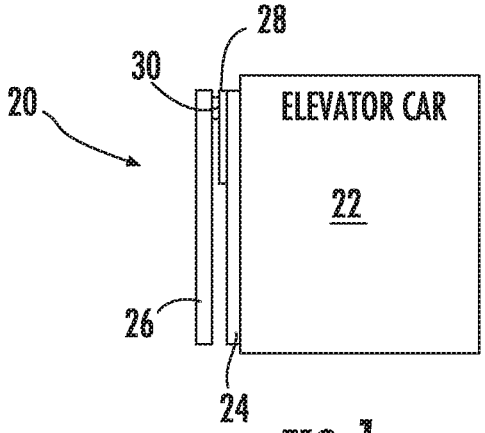
FIG. 1 schematically illustrates selected portions of an elevator system including a door interlock designed according to an embodiment of this invention.

FIG. 1 schematically illustrates selected portions of an elevator system 20. An elevator car 22 includes car doors 24 that are situated adjacent hoistway landing doors 26 when the elevator car 22 is parked at a landing. At least one vane 28 of a door coupler associated with the elevator car doors 24 cooperates with an interlock 30 associated with the hoistway doors 26 so that the elevator car doors 24 and the hoistway doors 26 move together between opened and closed positions.

FIGS. 2-5 show the interlock 30 of an example embodiment. The interlock 30 includes a first base 32 that is configured to be secured to a portion of a hoistway door 26, such as a hanger of the hoistway door 26. The first base 32 comprises a single, circular plate in this example. The first base 32 supports a first bumper 34, which comprises a roller in this embodiment. Other bumper configurations are useful in other example embodiments.

A second base 36 supports a second bumper 38, which also comprises a roller in this embodiment. A gap G between the bumpers 34 and 38 provides spacing for vanes 28 of the door coupler to be received between the bumpers 34 and 38.

Figure 2:
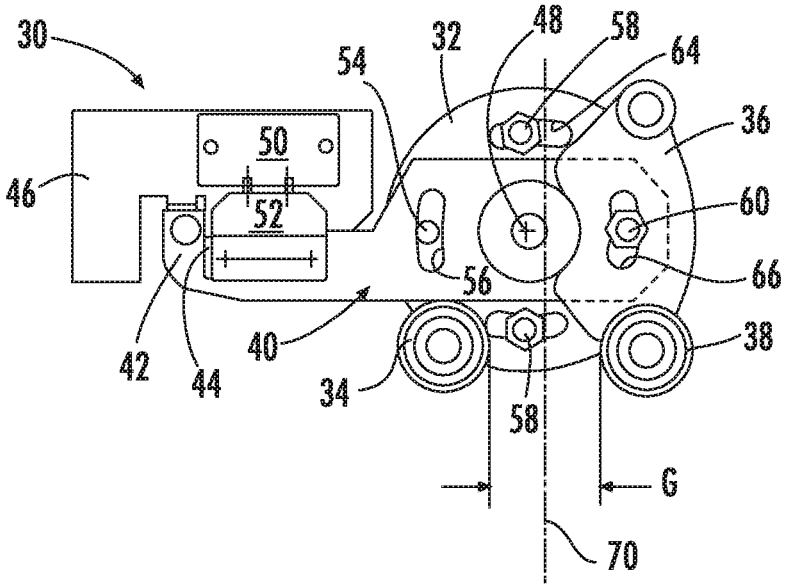
FIG. 2 is schematically shows an example elevator door interlock designed according to an embodiment of this invention with a latch in a locked position.
Figure 3:
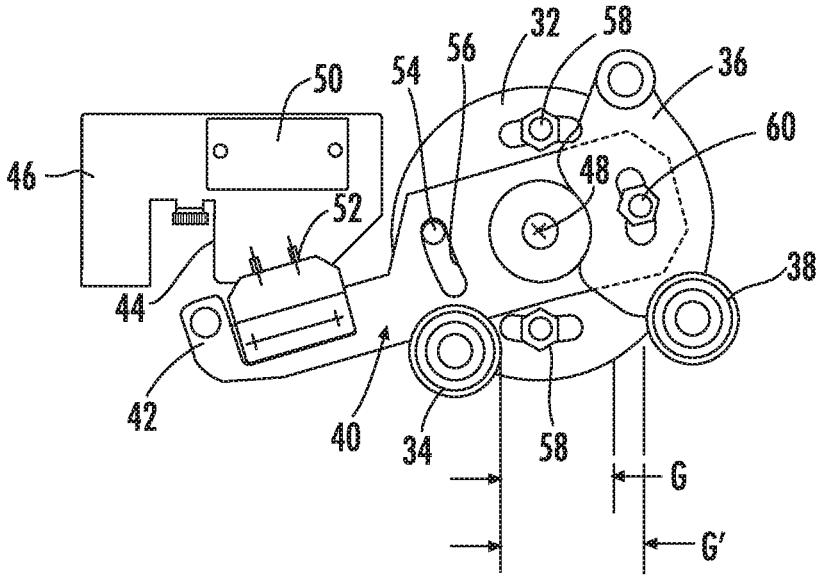
FIG. 3 shows the example interlock of FIG. 2 with the latch in a released position.

The interlock 30 includes a latch 40 that is moveable between a locking position (shown in FIG. 2) and a released position (shown in FIG. 3). A locking surface 42 on the latch 40 engages a stop 44 on a door lock 46 when the latch 40 is in the locking position. In the released position shown in FIG. 3, the locking surface 42 is clear of the stop 44 and the door 26 is free to move with the elevator car door 24. The latch 40 pivots or rotates about a pivot axis 48 as it moves between the locking and released positions.

The second base 36 moves with the latch 40. A mass of the second base 36 and the bumper 38 serves as a weight that biases the latch 40 into the locking position.

The lock 46 includes a switch 50 that provides an indication when the hoistway door 26 is properly locked. The latch 40 supports a switch contact 52 that is coupled with the switch 50 when the latch 40 is in the locking position. The switch contact 52 is separated from the switch 50 when the latch 40 is in the released position and the switch 50 provides an indication regarding the unlocked condition of the hoistway door 26 in a known manner.

In the illustrated example, the first base 32 includes a boss 54, which may comprise a post or pin, for example. The latch 40 includes an arcuate slot 56 into which the boss 54 is at least partially received. The boss 54 and slot 56 cooperate to limit the pivotal or rotary movement of the latch 40 about the pivot axis 48.

Figure 4:
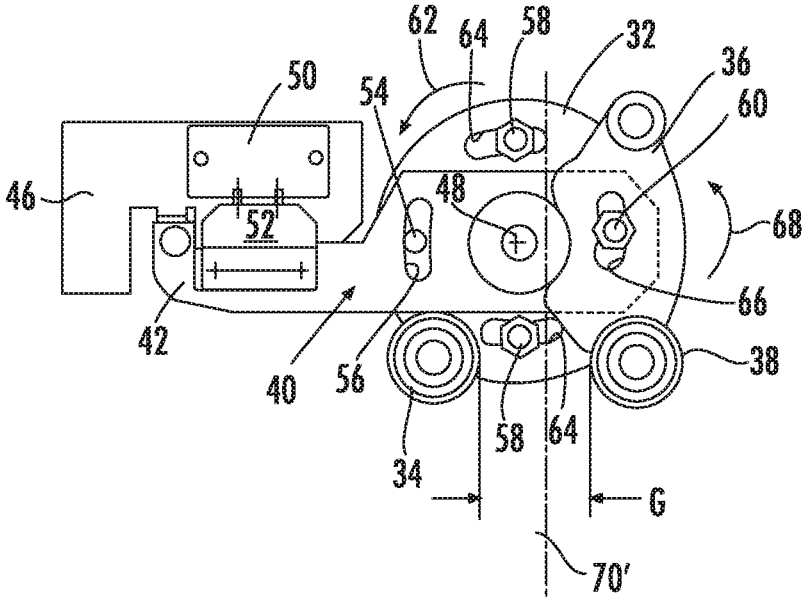
FIG. 4 shows an adjustment feature of the example interlock.

One of the features of the illustrated example embodiment is that it allows for adjusting the size of the gap G and setting the lateral position of the bumpers 34 and 38 so that the gap G is properly aligned with the vanes 28 of the door coupler. In this example, the first base 32 is moveable relative to the door component upon which the first base 32 is supported, such as the door hanger (not specifically illustrated). In this example, the first base 32 can be pivoted or rotated about the pivot axis 48 of the latch 40. Fasteners 58, such as threaded rods and nuts, secure the first base 32 in a selected fixed position relative to the door component. By loosening the fasteners 58, it is possible to move the first base 32 relative to the door component. In this embodiment, as shown in FIG. 4, the first base 32 can be pivoted or rotated as shown at 62 to change a position of the bumper 34. As the first base 32 rotates about the pivot axis 48, the bumper 34 follows an arcuate path that allows for changing the lateral or side-to-side position of the bumper 34 relative to the door component and the lock 46, for example. The example first base 32 includes arcuate slots 64 that allow for pivotal or rotary adjustment of the first base 32. Once the desired position of the bumper 34 is established, the fasteners 58 secure the first base 32 and the bumper 34 in a fixed position relative to the hoistway door 26.

The second base 36 is also moveable relative to the hoistway door 26 to allow for changing the position of the bumper 38. In the illustrated example, the fastener 60 is secured to the latch 40 and at least partially received through a slot 66 on the second base 36. In other embodiments the latch 40 includes a slot and the fastener is fixed to the second base 36. When the fastener 60 is loosened, the second base 36 can be rotated or pivoted as shown at 68 about the pivot axis 48 of the latch 40. Such movement of the second base 36 allows for changing the lateral or side-to-side position of the bumper 38. Once the desired position of the bumper 38 is achieved and the desired gap G is established, the fastener 60 secures the second base 36 in a fixed position relative to the latch 40. In most situations the latch 40 is in the locking position during the bumper position adjustment As shown in FIG. 2, the gap G has a centerline 70 that is laterally positioned relative to the pivot axis 48 based on the positions of the bumpers 34 and 38, respectively. By making an adjustment to the lateral or side-to-side positions of the bumpers 34 and 38, the same gap G can be established to accommodate the vanes 28 of the door coupler in a different location relative to the hoistway door 26 to achieve proper alignment with the door coupler. Comparing FIGS. 2 and 4, for example, the centerline 70' in FIG. 4 is further away from the pivot axis 48 than the centerline 70 in FIG. 2.

Figure 5:
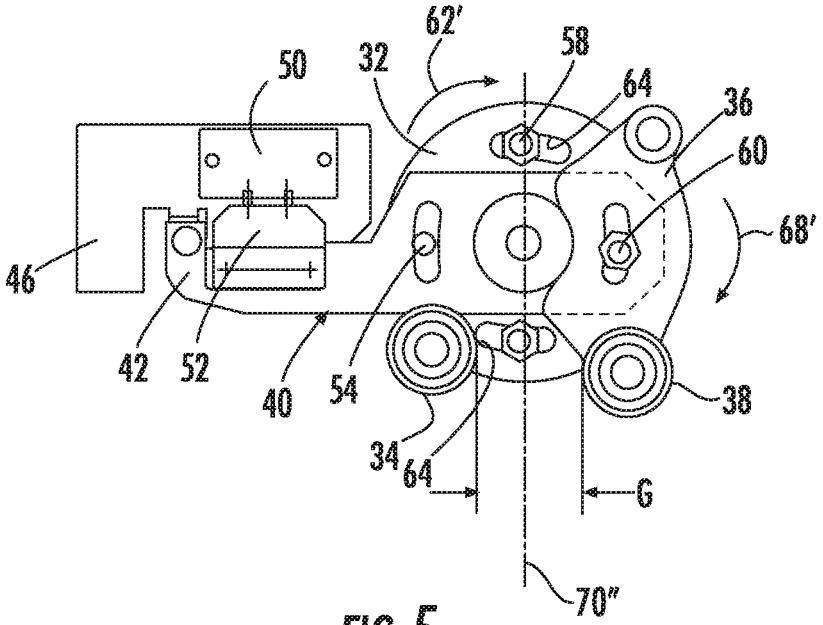
FIG. 5 shows the example interlock in another adjusted configuration.

FIG. 5 shows another adjusted condition in which the gap G has been shifted to the left (according to the drawings) compared to the positions shown in FIGS. 2 and 4, for example. By loosening the fasteners 58 and 60, the first base 32 can be pivoted or rotated as shown at 62' and the second base 36 can be pivoted or rotated as shown at 68'. Once the desired positions of the bumpers 34 and 38 are achieved and the appropriate gap G has been established, the fasteners 58 and 60 secure the first base 32 and second base 36 in appropriate positions, respectively. As can be appreciated by comparing FIGS. 4 and 5, the centerline 70 in FIG. 5 is further to the left (according to the drawings) compared to the centerline 70' in FIG. 4. Adjusting the position of the gap G relative to the pivot axis 48 does not require any adjustment of the relative positions of the switch 50 and the switch contact 52 because the pivot axis 48 of the latch 40 does not move during any of the adjustments.

Figure 6:
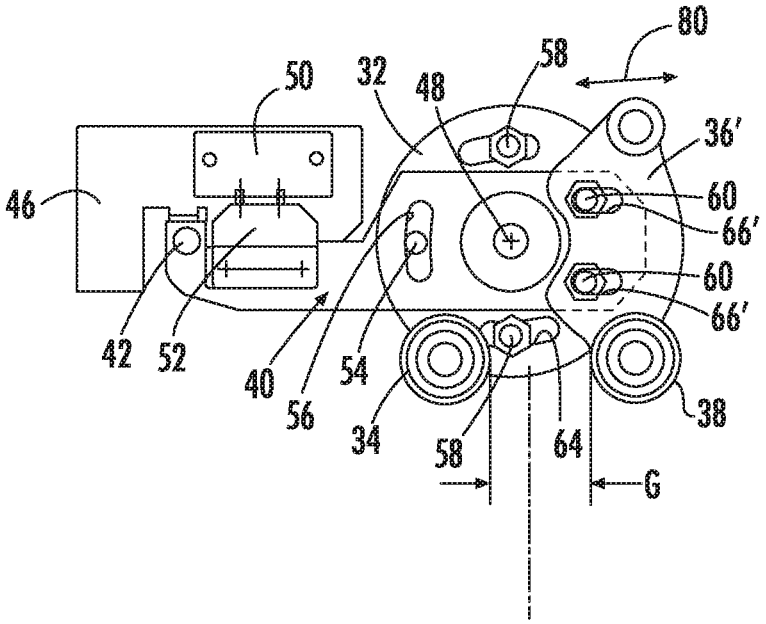
FIG. 6 schematically shows another example elevator door interlock designed according to an embodiment of this invention.

Another example embodiment is shown in FIG. 6. In this example, the first base 32 is moveable relative to the hoistway door 26 by rotating or pivoting the first base 32 about the pivot axis 48 of the latch 40 as included in the embodiment of FIGS. 2-5. The second base 36 in this example is moveable linearly instead of pivotally or rotationally. In this example, the second base 36' includes two slots 66' oriented to allow side-to-side or lateral movement of the second base 36 relative to the latch 40 as represented by the arrows 80. This embodiment also allows for changing the positions of the bumpers 34 and 38 to establish a gap G appropriately aligned with the vanes 28 of a door coupler without requiring any movement of the latch 40 relative to the lock 46 so that there is no risk of misalignment between the switch 50 and the switch contact 52.

Having the ability to adjust the position of the gap G allows for aligning interlocks 30 along an entire hoistway with the door coupler vanes 28 of the elevator car 22. Such lateral adjustments can be achieved to move the position of the bumpers 34 and 38 without having to move the locks 46 or the switches 50 for each set of hoistway doors. This provides a significant advantage in that there is no need to adjust the latch 40 relative to the lock 46 or switch 50, which simplifies the task of achieving desired alignment between the vanes 28 of the door coupler and the interlocks 30 along the hoistway. The relative positions of the pivot axis 48 of the latch 40 and the switch 50 does not need to change so that there is no risk of a misalignment between the switch 50 and the switch contact 52. Eliminating the need to adjust the relative positions of the switch 50 and the switch contact 52 enhances the reliability of proper operation of the elevator system and reduces the amount of labor required to achieve proper alignment between the door coupler vanes 28 and the interlocks 30 along a hoistway.

Another feature of the illustrated example embodiments is that they allow for the position of the latch pivot axis 48, the lock 46, the switch 50 and the switch contact 52 to all be pre-established in a controlled manufacturing setting. The interlock 30 may be installed as a preassembled unit, which further reduces labor, time and cost and further enhances the accuracy of the relative positions of the components of the interlock 30 leading to more reliable elevator system operation.

Interlocks designed according to an embodiment of this invention further facilitate reducing callbacks that are otherwise associated with problems or malfunctions caused by interlock misalignment. Embodiments of this invention provide cost savings not only during installation or maintenance procedures but also by reducing the need for maintenance or adjustment during the service life of the associated elevator system.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator door interlock, comprising:

a first base configured to be supported on a hoistway door component, the first base being situated to be selectively pivoted relative to the hoistway door component;

a first bumper supported on the first base such that pivotal movement of the first base changes a position of the first bumper relative to the hoistway door component;

a second base situated to be selectively moved relative to the hoistway door component;

a second bumper supported on the second base such that selective movement of the second base changes a position of the second bumper relative to the hoistway door component; and a latch situated for pivotal movement about a pivot axis relative to the first base between a door locking position and a released position, wherein the first base is selectively pivoted about the pivot axis.

2. The elevator door interlock of claim 1, wherein the second base is situated to be selectively pivoted relative to the hoistway door component; and the second base is selectively pivoted about the pivot axis.

3. The elevator door interlock of claim 2, wherein the second base is situated to be selectively pivoted relative to the first base;

the second base is situated to be selectively pivoted relative to the latch;

the second base is selectively set in a fixed position relative to the latch; and the second base and the second bumper pivot about the pivot axis with pivotal movement of the latch about the pivot axis when the second base is in the fixed position.

4. The elevator door interlock of claim 3, comprising at least one fastener that selectively secures the second base in the fixed position relative to the latch.

5. The elevator door interlock of claim 4, wherein when the second base is in the fixed position relative to the latch a mass of the second base urges the latch into the locking position.

6. The elevator door interlock of claim 2, wherein the second base is situated to be selected pivoted relative to the latch;

at least one of the second base and the latch includes a boss;

at least one of the other of the latch and the second base includes an arcuate slot;

the boss is at least partially received in the slot; and relative movement between boss and the slot adjusts a relative position between the latch and the second base.

7. The elevator door interlock of claim 6, wherein the boss comprises a threaded rod; and the elevator door interlock includes a threaded fastener that is received on the threaded rod to selectively secure the second base in a fixed position relative to the latch.

8. The elevator door interlock of claim 1, comprising a switch that provides an indication whether the latch is in the locking position and wherein the latch comprises a switch contact that cooperates with the switch when the latch is in the locking position;

the switch contact is separated from the switch when the latch is in the released position; and the switch remains in a fixed position relative to the pivot axis.

9. The elevator door interlock of claim 1, comprising at least one fastener that selectively holds the first base in a fixed position relative to the hoistway door component.

10. The elevator door interlock of claim 1, wherein at least one of pivotal movement of the first base and movement of the second base adjusts a lateral spacing between the first bumper and the second bumper.

11. The elevator door interlock of claim 1, wherein there is a first lateral spacing between the first and second bumpers when the latch is in the locking position; and there is a second, larger lateral spacing between the first and second bumpers when the latch is in the released position.

12. The elevator door interlock of claim 1, wherein the first bumper comprises a roller that is rotatable relative to the first base about a first roller axis that remains fixed relative to the first base; and the second bumper comprises a roller that is rotatable relative to the second base about a second roller axis that remains fixed relative to the second base.

13. The elevator door interlock of claim 1, wherein the first base includes at least one boss;

the latch includes at least one arcuate slot;

the boss is at least partially received in the slot; and at least one end of the slot limits pivotal movement of the latch into the released position.

14. The elevator door interlock of claim 1, wherein the second base is laterally moveable relative to the pivot axis.

15. An elevator door interlock, comprising:

a first base configured to be supported on a hoistway door component, the first base being situated to be selectively pivoted relative to the hoistway door component;

a first bumper supported on the first base such that pivotal movement of the first base changes a position of the first bumper relative to the hoistway door component;

a second base situated to be selectively moved relative to the hoistway door component;

a second bumper supported on the second base such that selective movement of the second base changes a position of the second bumper relative to the hoistway door component; and a latch situated for pivotal movement about a pivot axis relative to the first base between a door locking position and a released position, wherein there is a first lateral spacing between the first and second bumpers when the latch is in the locking position; and there is a second, larger lateral spacing between the first and second bumpers when the latch is in the released position.

16. An elevator door interlock, comprising:

a first base configured to be supported on a hoistway door component, the first base being situated to be selectively pivoted relative to the hoistway door component;

a first bumper supported on the first base such that pivotal movement of the first base changes a position of the first bumper relative to the hoistway door component;

a second base situated to be selectively moved relative to the hoistway door component;

a second bumper supported on the second base such that selective movement of the second base changes a position of the second bumper relative to the hoistway door component; and a latch situated for pivotal movement about a pivot axis relative to the first base between a door locking position and a released position, wherein the first base includes at least one boss;

the latch includes at least one arcuate slot;

the boss is at least partially received in the slot; and at least one end of the slot limits pivotal movement of the latch into the released position.

* * * * *